US008548346B2

(12) United States Patent
Robles Flores

(10) Patent No.: US 8,548,346 B2
(45) Date of Patent: Oct. 1, 2013

(54) LABEL PRESS FUSER ALGORITHM FOR FEEDING A CONTINUOUS ROLL OF LABEL MATERIAL THROUGH A SHEET FED PRINTING DEVICE

(75) Inventor: Eliud Robles Flores, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 199 days.

(21) Appl. No.: 13/273,938

(22) Filed: Oct. 14, 2011

(65) Prior Publication Data

US 2013/0094873 A1 Apr. 18, 2013

(51) Int. Cl.
*G03G 15/20* (2006.01)

(52) U.S. Cl.
USPC ..... 399/67

(58) Field of Classification Search
USPC ..... 399/66, 67, 68, 316, 384
See application file for complete search history.

(56) References Cited

U.S. PATENT DOCUMENTS 5,479,241 A 12/1995 Hou et al.
6,633,740 B2 10/2003 Estabrooks
6,661,989 B2 12/2003 Pitts et al.
7,054,571 B2 5/2006 Camp
7,249,903 B2 7/2007 Shaw, III
7,260,339 B2 8/2007 Carter et al.
7,653,331 B2 1/2010 Gross et al.
7,914,001 B2 3/2011 Hermann
2003/0039488 A1 2/2003 Fayette et al.
2006/0285134 A1 12/2006 Viturro et al.
2010/0214580 A1 8/2010 Burry et al.
2010/0329702 A1 12/2010 DiRubio et al.

*Primary Examiner* — Walter L Lindsay, Jr
*Assistant Examiner* — Barnabas Fekete
(74) *Attorney, Agent, or Firm* — Ronald E. Prass, Jr.; Prass LLP

(57) ABSTRACT

According to aspects of the embodiments, there is provided an apparatus and method to use a fuser speed algorithm to engage a web print media to a rotatable image carrier (PR) during transfer of toner to paper without additional parts or tight web requirement. The fuser speed algorithm can drive the web through a sheet fed printer efficiently by only using the fuser nip as the main drive. The fuser speed algorithm leverages the advantage of fuser speed to enable the required speed and tension at transfer for proper engagement, then release tension to create slack web at transfer so the PR drives create a buckle zone prior to the fuser system. The fuser speed algorithm drives the fuser at the nominal desired speed which is slower than PR speed to maintain the buckle zone.

20 Claims, 7 Drawing Sheets

LABEL PRESS FUSER ALGORITHM FOR FEEDING A CONTINUOUS ROLL OF LABEL MATERIAL THROUGH A SHEET FED PRINTING DEVICE

BACKGROUND

This disclosure relates in general to copier/printers, and more particularly, to feeding a continuous web of material from a roll to a sheet fed printing device such as a conventional sheet fed printer.

Generally, labels are printed by a continuous printing process utilizing a roll label print media. Generally the continuous process for printing labels has been reserved to the flexographic, gravure and thermal printing processes. Flexographic printing, also known as aniline printing, is a form of relief printing in which a slightly raised image of the label is formed on a printing plate by engraving. Each plate has a high initial cost and has a limited life, requiring periodic replacement. Generally, a print run must be on the order of thousands of labels in order for the print run to be cost effective. In gravure printing, the printing area is etched into a surface of a plate or a metal cylinder. Generally, a print run for a gravure system is on the order of millions of copies in order to be cost effective. Thus, gravure systems suffer from the same drawbacks for a short print run as do flexographic systems. Thermal printing is a non-impact printing process that uses heat to register an impression on paper. The major drawback to thermal printing compared to flexographic and gravure printing is the relatively low quality of the printed image, especially on print media that is not specialty paper. Further, thermal printing equipment is also very expensive to purchase and to maintain as the print heads must be cleaned frequently to remove melted wax or burned-on ink.

Prior art systems have previously attempted to address the feeding of a continuous roll of paper to a laser printer in a number of ways. In the prior art, sheet fed printer have been redesigned with feeding and cutting mechanisms that are integrated with the printing device. However, such redesigns tend to forgo the efficiencies and low costs of conventional laser printing devices.

For the reasons stated above, and for other reasons stated below which will become apparent to those skilled in the art upon reading and understanding the present specification there is need in the art for systems, apparatus, and/or methods to convey a continuous web of print media through a marking station.

SUMMARY

According to aspects of the embodiments, there is provided an apparatus and method to use a fuser speed algorithm to engage a web print media from the photoreceptor (PR) during transfer of toner to paper) without additional parts or tight web requirement. The fuser speed algorithm can drive the web through a sheet fed printer efficiently by only using the fuser nip as the main drive. The fuser speed algorithm leverages the advantage of fuser speed to enable the required speed and tension at transfer for proper engagement, then release tension to create slack web at transfer so the PR drives create a buckle zone prior to the fuser system. The fuser speed algorithm drives the fuser at the nominal desired speed which is slower than PR speed to maintain the buckle zone.

DETAILED DESCRIPTION

Figure 1:
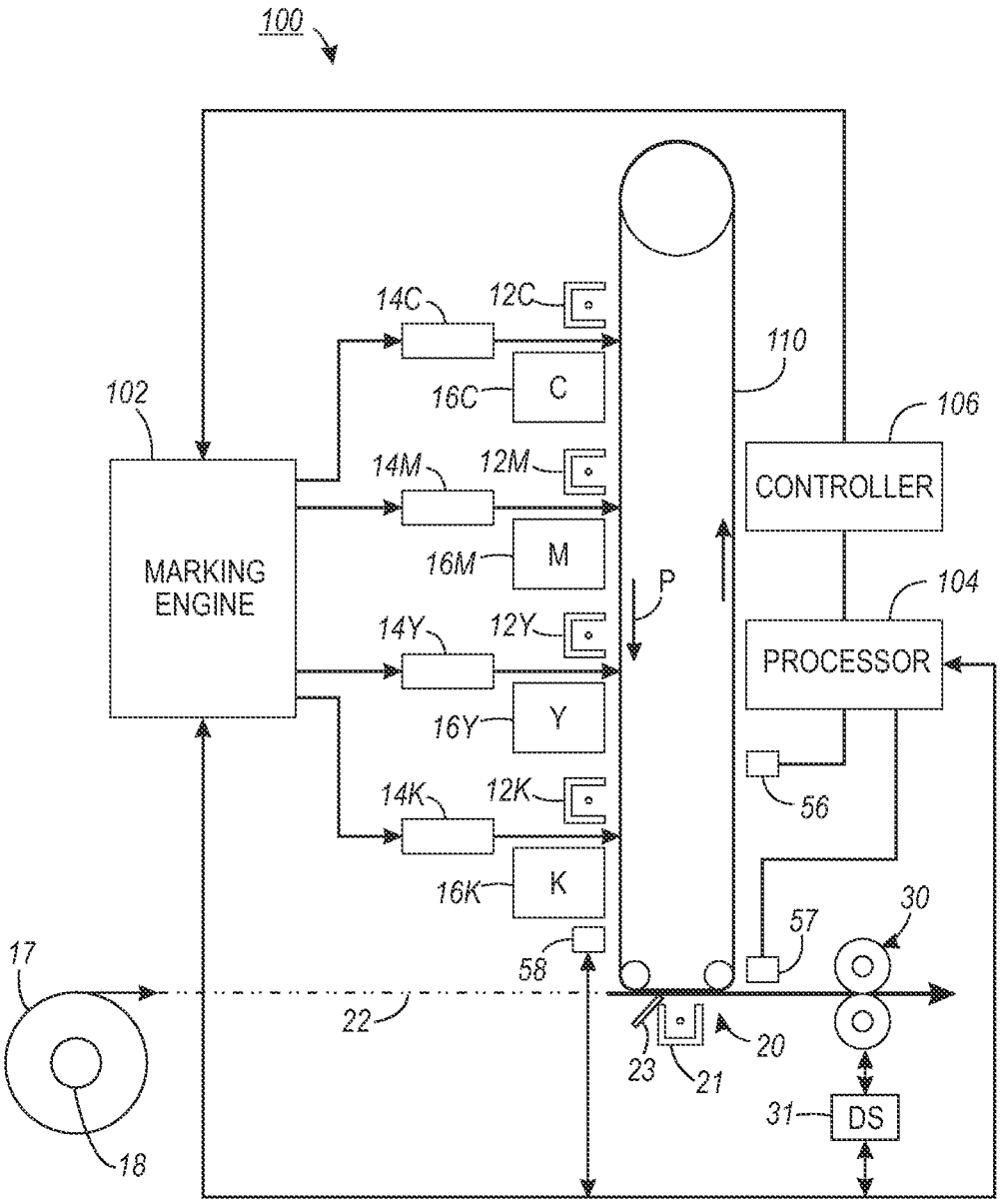
FIG. 1 illustrates a schematic view of an image printing system in accordance to an embodiment.

In accordance with various aspects described herein, systems and methods are described a fuser speed algorithm to enable disengage a web from the PR after transfer without additional parts or tight web requirement. The fuser speed algorithm uses fuser nip as the main drive. The nip is used to regulate tension and to create slack web at transfer so the PR drives, the fuser is then driven at the nominal desired speed.

Aspects of the disclosed embodiments relate to An image forming device to print a continuous web of print media comprising a transfer system for printing on the print media, the transfer system having a photoreceptor belt capable of moving at a process speed and arranged to transfer one or more images to the continuous web of print media; the transfer system having a transfer device (dicorotron) capable of applying the transfer field; the transfer system having a transfer assist unit (TAB) capable of applying light pressure to back of media; a fuser unit having a drive system and rolls in nipped relation, wherein the drive system causes rotation at the rolls so as to advance the print media; and a controller to control the transfer system and the fuser unit, wherein the controller is coupled to a memory for storing executable instructions to engage the continuous web of print media by directing the processor to: operate the drive system at the process speed to create a first tension on the continuous web of print media as it advances through the nip; operate the photoreceptor belt at the process speed; operate the drive system at a speed lower than the process speed to create a second tension on the continuous web of print media as it advances through the nip, wherein the second tension creates a buckle zone prior to the fuser unit; engage the transfer system to print on the print media.

In yet another aspect of the disclosed embodiment the image forming device wherein engaging a transfer system comprises initially turning a transfer dicor to a low transfer field, fine tuning the transfer field until tacking occurs, and increasing the transfer field to a predetermined value for the print media. In conjunction to the transfer field, the transfer assist unit (TAB) is engaged to apply light pressure to the back of media.

In yet another aspect of the disclosed embodiment the image forming device the image forming device memory further comprising executable instructions to disengage the continuous web of print media by directing the processor to operate the drive system at a speed higher than the process speed to create a third tension on the continuous web of print media as it advances through the nip; disengage the transfer system from the print media; operate the photoreceptor belt at a speed that is substantially at rest; incrementally operate the drive system to reduce speed until the continuous web of print media is substantially at rest.

In yet another aspect of the disclosed embodiment the image forming device wherein operate the drive system at the process speed to create a first tension further comprises achieving running stability and tracking stability of the continuous web of print media.

In yet another aspect of the disclosed embodiment the image forming device wherein operate the photoreceptor belt to move the print media through the print station further comprises achieving tracking stability of the continuous web of print media.

In still another aspect of the disclosed embodiment the image forming device wherein disengage the transfer system from the print media further comprises waiting until the buckle zone is reduced and running stability of the continuous web of print media.

In yet another aspect of the disclosed embodiment the image forming device wherein a speed lower than the process speed is nominal speed.

Aspects of the disclosed embodiments relate to a method of conveying a continuous web of print media from a marking station to a nip formed by a first roll and a second roll, comprising operating the first roll and second roll at a process speed to create a first tension on the continuous web of print media as it advances through the nip; operating photoreceptor belt to move through the marking station at the process speed; operating the first roll and second roll at a speed lower than the process speed to create a second tension on the continuous web of print media as it advances through the nip, wherein the second tension creates a buckle zone prior to the a first roll and second roll; engaging the marking station to print on the print media.

Another disclosed embodiment is to a printing assembly for printing a continuous web of print media comprising a sheet fed printer comprising a print station for printing an image on the print media, photoreceptor belt capable of moving at a process speed and arranged to transfer one or more images to the print media, and a print controller configured and arrange for controlling operation of the photoreceptor belt and the printing station, a continuous web print media feed unit including a continuous web of print media capable of receiving a print image, a print media fusing station configured and arranged for advancing the print media through the printer, at least one sensor for sensing the position of the print media as the print media is fed to the printer, and a fusing controller configured and arranged for controlling the operation of the print media fusing station, the fusing controller being in operative two-way communication with the print controller for sending at least one control signal to the print controller and for receiving at least one control signal from the print controller, the fusing controller is coupled to a memory for storing executable instructions to convey a continuous web of print media from the print station to a nip formed by a first roll and a second roll at the fusing station by operating the first roll and second roll at a process speed to create a first tension on the continuous web of print media as it advances through the nip; operating photoreceptor belt to move through the print station at the process speed; operating the first roll and second roll at a speed lower than the process speed to create a second tension on the continuous web of print media as it advances through the nip, wherein the second tension creates a buckle zone prior to the a first roll and second roll; engaging the print station to print on the print media.

The term "print media" generally refers to a usually flexible, sometimes curled, physical sheet of paper, plastic, or other suitable physical print media substrate for images, whether precut or web fed.

The term "rotatable image carrier" generally refers to a belt, drum, and or intermediate belt on which multiple-primary color images, created xerographically or otherwise such as ink-jet are built up for transfer to the print media or web.

The term "transfer device" generally refers to a dicorotron or any element suitable for directing a predetermined charge to a predetermined zone.

The term "image forming machine" as used herein refers to a digital copier or printer, electrographic printer, bookmaking machine, facsimile machine, multi-function machine, or the like and can include several marking engines, as well as other print media processing units, such as paper feeders, finishers, and the like. The term "electrophotographic printing machine," is intended to encompass image reproduction machines, electrophotographic printers and copiers that employ dry toner developed on an electrophotographic receiver element.

The disclosed embodiments below will be described with reference to toner.

FIG. 1 illustrates a schematic view of an image printing system 100 in accordance to an embodiment. Specifically, there is shown an "image-on-image" xerographic color image printing system, in which successive primary-color images are accumulated on an image bearing surface 110 (e.g., a photoreceptor belt). This particular type of printing is also referred as "single pass" multiple exposure color printing. In one implementation, the Xerox Corporation iGen3® or iGen4® digital printing press may be utilized. However, the present disclosure is not limited to an image-on-image xerographic color image printing system. It is appreciated that any image printing machine, including machines that print on photosensitive substrates, xerographic machines with multiple photoreceptors, or ink-jet-based machines, may utilize the present disclosure as well. The system may also be used in analog and digital copiers, scanners, facsimiles, or multifunction machines. The image bearing surface 10 may have photoreceptor registration markings (not shown), as disclosed in U.S. Pat. No. 6,369,842, herein incorporated by reference in its entirety.

The image printing system 100 typically uses one or more Raster Output Scanners (ROS) to expose the charged portions of the image bearing surface 110 to record an electrostatic latent image on the image bearing surface 110. Further examples and details of such image on image printing systems are described in U.S. Pat. Nos. 4,660,059; 4,833,503; and 4,611,901, each of which herein is incorporated by reference in its entirety. U.S. Pat. No. 5,438,354, the entirety of which is incorporated herein by reference, provides one example of a Raster Output Scanner (ROS) system.

However, it should be appreciated that the present disclosure could also be employed in non-xerographic color printing systems, such as ink jet printing systems. The present disclosure could also be employed in "tandem" xerographic, tightly integrated parallel printing (TIPP), or other color printing systems, typically having plural print engines transferring respective colors sequentially to an intermediate image transfer belt and then to the final substrate. Thus, for a tandem color printer (e.g., U.S. Pat. Nos. 5,278,589; 5,365,074; 6,219,516; 6,904,255; and 7,177,585, each of which herein is incorporated by reference in its entirety) or a TIPP system (e.g. U.S. Pat. Nos. 7,024,152 and 7,136,616, each of which herein is incorporated by reference in its entirety) it will be appreciated that the image bearing surface may be either or both on the photoreceptors and the intermediate transfer belt, and have sensors and image position correction systems appropriately associated therewith. Various such known types of color image printing systems are further described in the above-cited patents and need not be further discussed herein.

In one embodiment, the image bearing surface 110 is at least one of a photoreceptor drum, a photoreceptor belt, an intermediate transfer belt, an intermediate transfer drum, and other image bearing surfaces. That is, the term image bearing surface 110 means any surface on which an image is received, and this may be an intermediate surface (i.e., a drum or belt on which an image is formed prior to transfer to a printed web). A pre-transfer erase (not shown) is preferably on the front surface of the photoreceptor drum (which is not transparent). A transfer dicor (T) and detack dicor (DT) 21 generates a transfer field by depositing charge on the back of the web 22. The field can be varied by adjusting the control biases on the dicorotron 21. In certain versions of the Xerox Corporation iGen3® or iGen4® digital printing press the photoreceptor belt 110 is vibrated at ultrasonic frequencies to mechanically loosen the toner as the transfer field is applied by the dicorotron 21. The dicorotrons produce a voltage potential on the media substrate such as web 22 to transfer the developed latent image onto the media substrate. The dicorotron includes a coronode member which is preferably a wire and shield (not shown). The transfer assist blade 23 component applies light pressure in the back of the media, as a way to aid toner transfer. Power supply provides a current source for supplying a constant current to shield. Voltage monitor measures the voltage on the shield. The voltage monitor periodically polls the voltage during a cycle of a print job and generates a voltage measured signal as a function thereof.

The system 100 includes a marking engine 102, a drive system 31, a processor 104, and a controller 106. The marking engine 102 is configured to mark an image on the image bearing surface 10 moving in a process direction. For example, see U.S. patent Published Application 20100214580 A1 filed on Feb. 23, 2009, herein incorporated by reference in its entirety. In one embodiment, the image marked with the marking engine on the image bearing surface 110 is a toner image. A series of stations are disposed along the image bearing surface 110, as is generally familiar in the art of xerography, where one set of stations is used for each primary color to be printed (e.g. C, M, Y, K). The processor 104 is configured to generate a reflectance profile of the image by based on the sensed reflectance of the image in a process and/or cross-process direction. The controller 106 is configured to adjust the position and/or rotational velocity of rotating developers 36C, 36M, 36Y, and 36K and to control drive system 31 to move the continuous web print media from feed unit 17 through transfer unit 20 with photoreceptor 110. The roll feeding unit 17 supports a continuous roll of web material which serves as the imaging medium. The roll of web material is mounted on a core 17. The web can be made of any suitable material that will receive a printed image. For example, suitable materials include paper, plastic films, card stock, paper board, card board, textile materials such as non-woven fabrics, metal foils, and the like. The web material can have a transparent or opaque nature. Additionally, controller 106 may also act as a transfer field controller that may control the transfer field applied to each toner image transfer device which forms part of marking engine 102. The controller 106 may receive control parameters from marking engine 102, such as an initial transfer field to apply to each respective toner image transfer device in image printing system 100 and may periodically receive instructions from a residual mass per area (RM/A) analysis unit (not shown) to either increase, or decrease, the transfer field applied to one or more of the respective toner image transfer devices. Initially the transfer filed is low and is then gradually increased until desired value for the print media is reached.

While reference to sensing a reflectance characteristic is disclosed herein, it should be appreciated that other optical characteristics may also be sensed and used in conjunction with the disclosed embodiments. For example, in one embodiment, a transmissive sensor may be used for measuring the density of a colorant on the image bearing surface. The sensed transmission data would be used in the same basic fashion with the rest of the compensation approach using reflectance data. Indeed, the methodology disclosed herein is essentially the same, independent of the specific sensing mode implemented.

In one embodiment, the image may be applied on the image bearing surface 110 by one or more lasers such as 14C, 14M, 14Y, and 14K. As should be appreciated by one skilled in the art by coordinating the modulation of the various lasers such as 14C, 14M, 14Y, and 14K with the motion of the image bearing surface 110 and other hardware, the lasers discharge areas on the image bearing surface 10 to create exposed negative areas before these areas are developed by their respective developer units 16C, 16M, 16Y, 16K.

For example, to place a cyan color separation image on the image bearing surface 110, there is used a charge corotron 12C, an imaging laser 14C, and a developer unit 16C. For successive color separations, there is provided equivalent elements 12M, 14M, 16M (for magenta), 12Y, 14Y, 16Y (for yellow), and 12K, 14K, 16K (for black). The successive color separations are built up in a superimposed manner on the surface of the image bearing surface 110, and then the image is transferred from the image bearing surface 110 (e.g., at transfer station 20) to the web to form a printed image on the web. The output web is then run through a fuser 30, as is familiar in xerography. In the preferred embodiment the Fuser nip as the main drive for moving the web through transfer station 20 so as to be printed on.

The system 100 includes sensors 56, 57 and 58 that are configured to provide feedback to the processor 104 to achieve Web running stability, fuser tracking/steering stability, PR tracking/steering stability, and other tracking and steering functions that are well known to those in the art. The sensors 56, 57 and 58 are configured to scan images created on the image bearing surface 110 and/or to scan test patterns. Sensor 57 is configured to scan image created in output prints, including paper prints. Sensors 56, 57 and/or 58 may also include a spectrophotometer, color sensors, or color sensing systems. For example, see U.S. Pat. Nos. 6,567,170; 6,621,576; 5,519,514; and 5,550,653, each of which herein is incorporated by reference in its entirety. In an embodiment, the sensors 56, 57 and/or 58 may be placed just before or just after the transfer station 20 where the toner is transferred to the web. It should be appreciated that any number of sensors may be provided, and may be placed anywhere in the image printing system as needed, not just in the locations illustrated.

Preferably, the sensors may include, for example, a full width array (FWA) sensor. A full width array sensor is a sensor that extends substantially an entire width (e.g., cross-process direction) of the moving image bearing surface. It is understood that other linear array sensors may also be used, such as contact image sensors, CMOS array sensors or CCD array sensors. Although the FWA sensor or contact sensor is shown in the illustrated embodiment, it is contemplated that the present disclosure may use sensor chips that are significantly smaller than the width of the image bearing surface, through the use of reductive optics. In one embodiment, the sensor chips may be in the form of an array that is one or two inches long and that manages to detect the entire area across the image bearing surface through reductive optics. In one embodiment, a processor may be provided to both calibrate the linear array sensor and to process the reflectance data detected by the linear array sensor. It could be dedicated hardware like ASICs or FPGAs, software, or a combination of dedicated hardware and software. Sensors 56, 57 and 58 may also be Enhanced Toner Area Coverage (ETAC) sensors. For example, see e.g., U.S. Pat. No. 6,462,821, herein incorporated by reference in its entirety.

Figure 2:
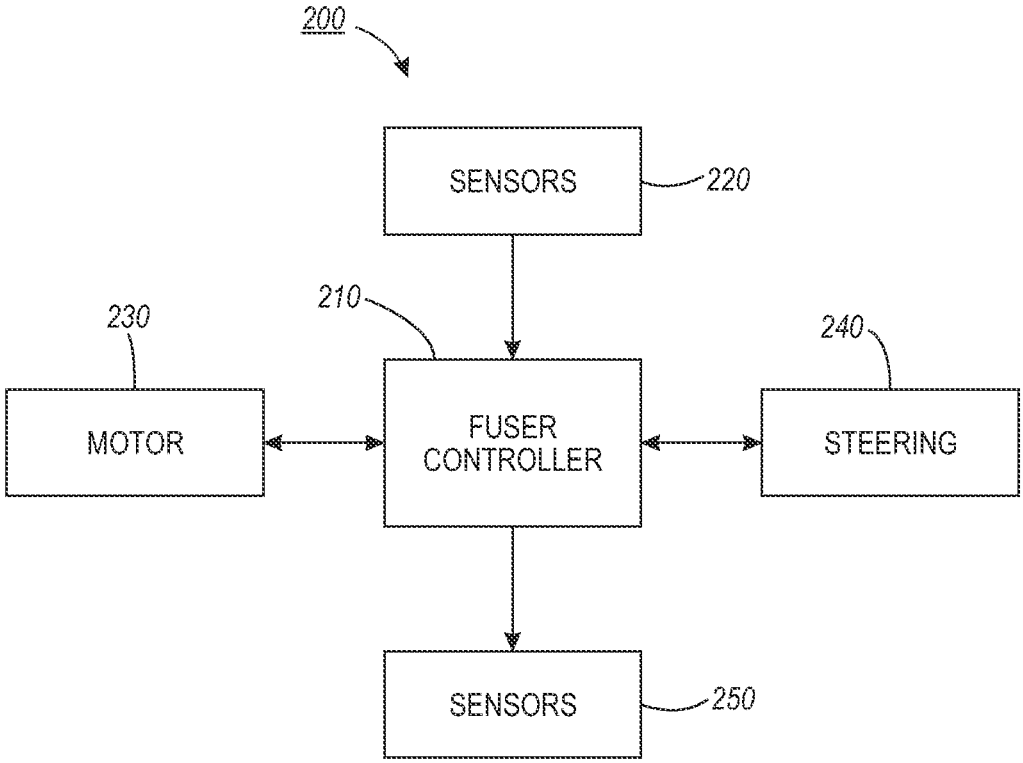
FIG. 2 illustrates a fuser control subsystem for printing a continuous web of print media in accordance to an embodiment.

FIG. 2 illustrates a fuser control subsystem 200 for printing a continuous web of print media in accordance to an embodiment, fuser control subsystem (FCS) 200 is included to illustrate the main components of a fuser subsystem and photoreceptor belt steering subsystem (PBSS). In particular, the user control subsystem 200 (FCS or PBSS) comprises fuser controller 210, sensors 220, motor 230, steering 240, and storage devices. The Fuser controller 210 may be implemented with a general-purpose processor. However, it will be appreciated by those skilled in the art that the fuser controller 210 may be implemented using a single special purpose integrated circuit (e.g., ASIC, FPGA, or the like) having a main or central processor section for overall, system-level control, and separate sections dedicated to performing various different specific computations, functions and other processes under control of the central processor section such as controller 106. Further, fuser controller 210 may be a plurality of separate dedicated or programmable integrated or other electronic circuits or devices. Here, as one skilled in the art would appreciate, the belt may be one of a photoreceptor belt, a transfer belt, a drying belt, a fusing belt, a returning belt, or the like.

The sensors 210 can include one or more light source with one or more photodetector, strain gauge, or any other position-determining sensor that outputs position data of a first roll and a second roll or belt that can be detected by the position-determining sensor. A suitable light source could be one or more light emitting diode (LED). Regardless of the type of sensor used the signal from each individual sensor is a digital representation of the roll's or belt's current position, with an accuracy defined by the sensor or the distance between two adjacent sensors when used in combination to determined position. Furthermore, position-determining marks with an encoder can generate a belt-conveying signal indicative of the belt movement in the conveying direction. Various sensors and methodologies can provide the controller with a real-time indication of the position and the speed of each belt, roll, drum, and the like.

The motor 230 is inclusive of a driving mechanism that can comprise driving rollers that rotate and drive a belt, a driving motor that provides a driving force to a driving roller, and a driving motor controller that controls a driving motor to maintain the speed of the motor and to limit transient conditions.

The steering 240 is inclusive of a steering motor controller that can control the positioning of belts and the like based on data from sensors 220, fuser controller 210, and storage device 250. Storage device 250 stores data including minimum weaving of a belt or web, initial position, initial set point data, position of the steering roller that corresponds to a position of a belt or web in real-time, and a snapshot of operational data that indicates the operation of the belt, web, rollers and the like. This data is made available to all processing systems in printing system 100.

Figure 3:
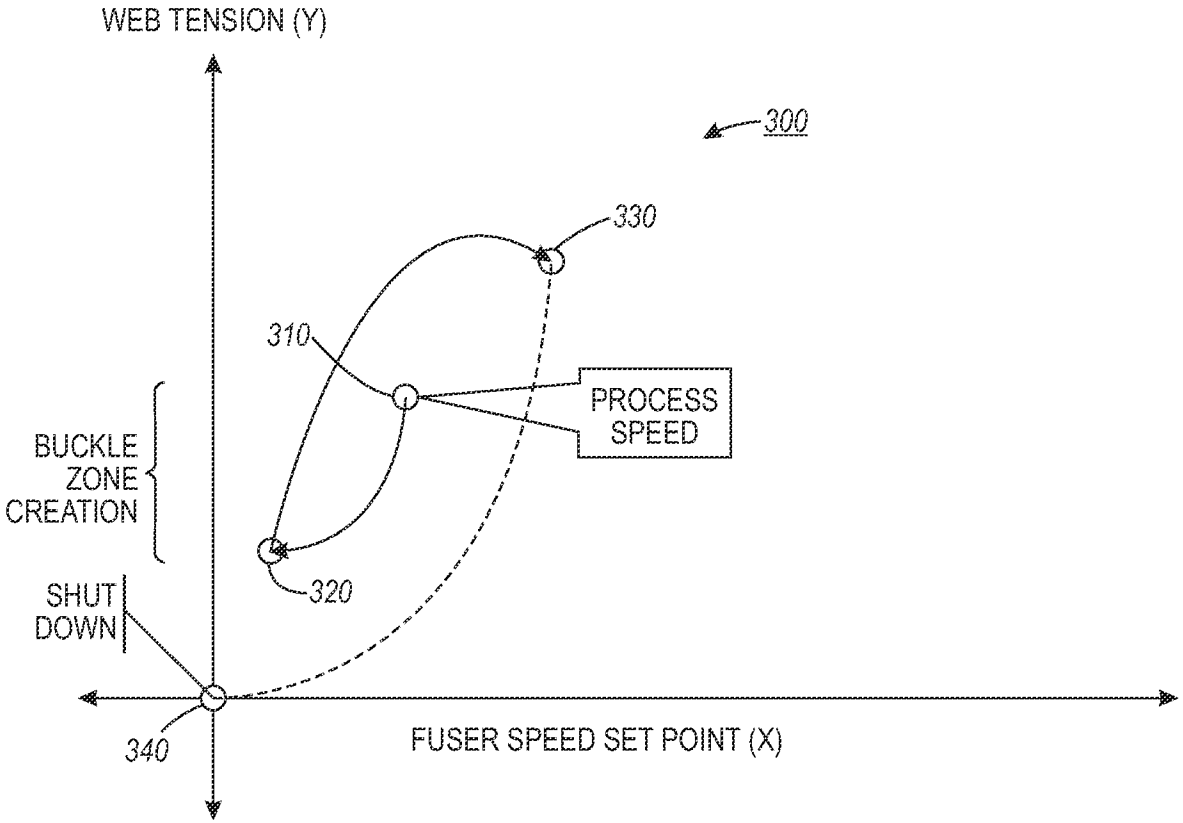
FIG. 3 is an illustration showing the relationship between fuser speed and web tension in accordance to an embodiment.

FIG. 3 is an illustration 300 showing the relationship between fuser speed and web tension in accordance to an embodiment. In particular, graphical representation 300 shows an X-Y axis of fuser speed set point set point and web tension. As a print media (web) passes through a nip formed by two rolls, the load applied by the pressure roll on the fuser roll increases as the leading edge of the print media passes through the nip. The load causes a force to be exerted on the web in the direction of travel. The force on the web from the nip between fuser roll and back-up roll typically is larger than the combination of the forces from the nips at the transfer station and the electrostatic force acting on the web, and thus the nip pressure and transport speed at fuser roll tend to dominate the transport speed of the web conveyed through the transfer station, i.e., process speed. If the fuser roll is overdriven such that the fuser-controlled media velocity is much greater than that of the transfer station, then tearing and skewing of the web can occur. When the fuser-controlled media velocity is less than the transfer station then the web forms what is known as a bubble or buckle that occurs before the entrance of the fuser system.

During the engagement phase the fuser system is initially set to the speed that the transfer station is expected to operate when performing printing functions, i.e., the speed of the web is initially set at process speed 310. At the transfer station the photoreceptor is set to process speed and the fuser speed is then set to a speed lower than the process speed 320. The difference between fuser speed and the speed of the photoreceptor creates a buckle zone. The transfer station engagement with the web begins and material is printed in accordance to the print job.

During the disengagement phase the fuser system is set to speed greater than the process speed 310. This increase in fuser speed increase the tension on the web and the buckle zone prior to the fuser unit is removed since the web no longer has any slack. The transfer station is disengaged and the speed of the photoreceptor belt is reduced to substantially zero. The speed of the fuser system is incrementally lower until it also reaches substantially zero 340.

Figure 4:
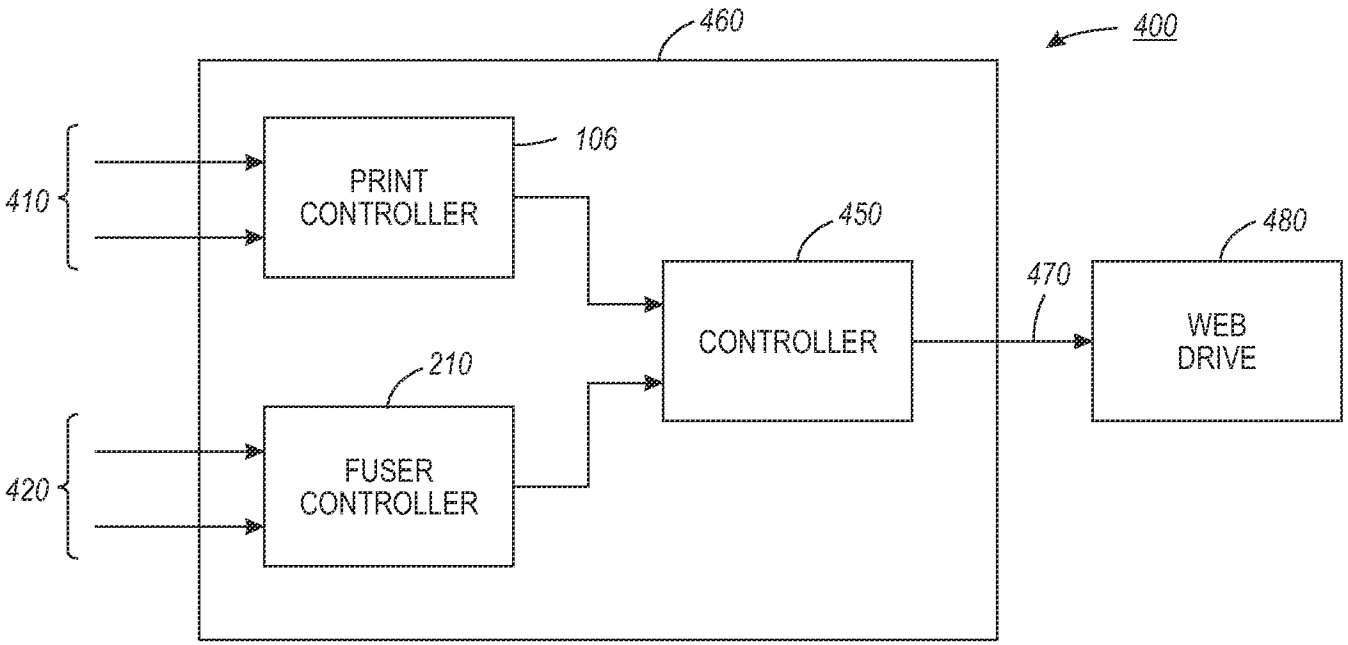
FIG. 4 illustrates a block diagram of an apparatus for web drive controlling in accordance to an embodiment.

FIG. 4 illustrates a block diagram of an apparatus 400 for web drive controlling in accordance to an embodiment. In particular apparatus 400 comprises photoreceptor belt input signal 410, fuser system input signal 420, print controller 106, fuser controller 210, controller, and web drive 480 such as drive system 31 shown in FIG. 1. Since subsystem controllers could all be performed by one single processor a single controller 460 is likewise represented.

Photoreceptor belt input signals 410 are processed by first processor 430 to perform steering/tracking functions in addition to printing functions. Fuser system input signals 420 are processed by fuser controller 210 to perform steering/tracking functions and governing the speed of the fuser system. The processed data from the print controller 106 and fuser controller 210 is then processed by controller 450 so as to generate a signal 470 that would regulate the drive of the web through the transfer station. The controllers (106, 210, 450) or certain functions could be encased in a fuser control module 460.

Figure 5:
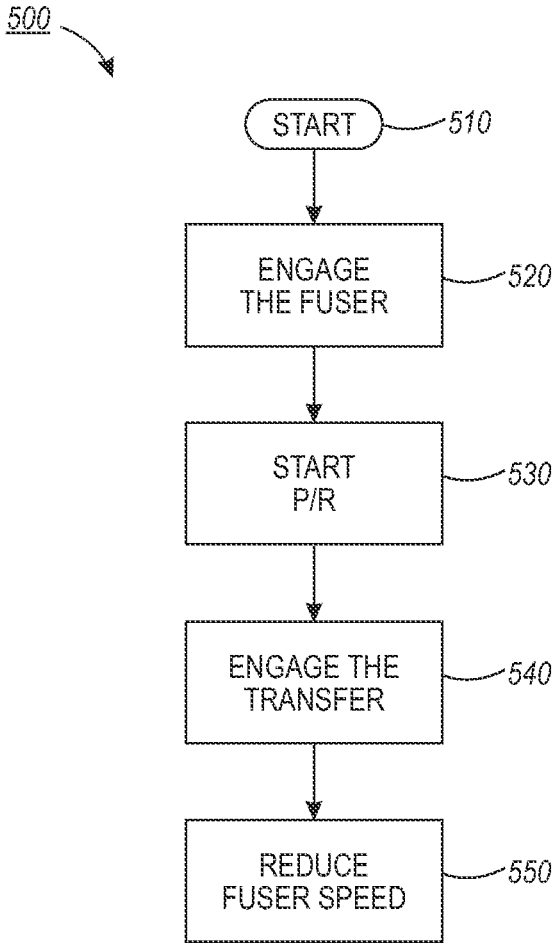
FIG. 5 is a method to engage the continuous web of print media using a fuser speed algorithm in accordance to an embodiment.

FIG. 5 is a method 500 to engage the continuous web of print media using a fuser speed algorithm in accordance to an embodiment. Method 500 begins with action 510 when a continuous web of print media is inserted into sheet fed printer such as shown in FIG. 1 Control is then passed to action 520 with engaging the fuser to drive the web through iGen® efficiently by only using the Fuser nip as the main drive. In action 520, start running the Web at PR speed (process speed) with the Fuser as main drive, achieve Web running stability via media path sensor stability, achieve Fuser tracking/steering stability via fuser sensor stability. Control is then passed to action 530 which starts the PR and achieves PR tracking/steering stability via image-on-image (IOI) registration response. Control is then passed to action 540 where the transfer is engage by turning "ON" the Transfer dicor at a low Transfer field, fine tuning the transfer field until tacking occurs via paper size ("PS") response, achieve PR tracking/steering stability via IOI/Reg response, increase Transfer field to desired value for media, achieve PR tracking/steering stability via IOI/Reg response. Control is then passed to action 660 where the process reduce fuser speed so that it will create a buckle zone to enable slack web at transfer by setting fuser speed at nominal setpoint.

Figure 6:
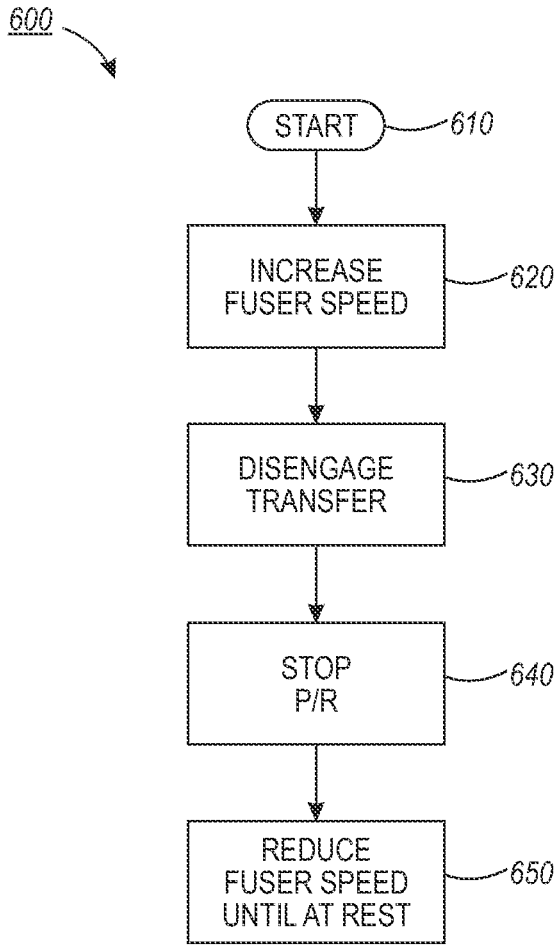
FIG. 6 is a method to disengage the continuous web of print media using a fuser speed algorithm in accordance to an embodiment.

FIG. 6 is a method to disengage the continuous web of print media using a fuser speed algorithm in accordance to an embodiment. Method 600 begins with action 610 which starts the disengage algorithm for disengaging the web from the transfer station after completion of a print run. The method in action 620, increases fuser speed to slightly higher than photoreceptor (PR) or process speed. The increase if speed will create tight web at Transfer. Control is then passed to action 630 where disengage Transfer turning "OFF" the transfer dicor and wait until Web drops and stabilizes via media path sensor stability. Control is then passed to action 640 and action 650 where the photoreceptor is stopped and the speed of the fuser is incrementally reduced until the web is at rest.

Figure 7:
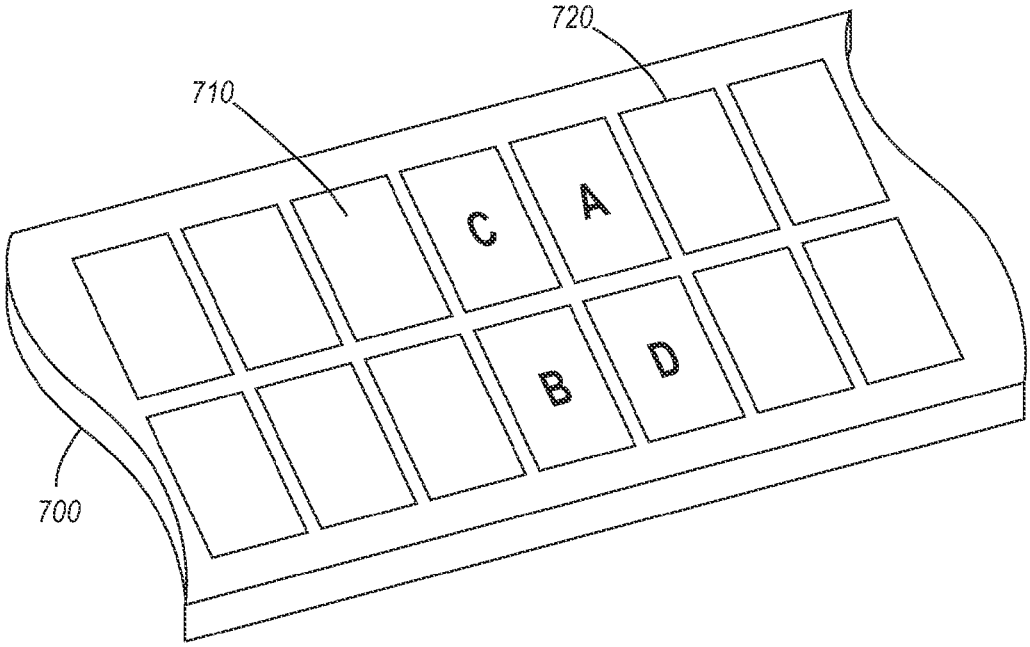
FIG. 7 is a perspective view of a continuous web material carrying labels in accordance to an embodiment.

FIG. 7 is a perspective view of a continuous web material carrying labels 700 in accordance to an embodiment. The continuous web 22 is illustrated as comprising a backing material carrying a set of pressure-sensitive adhesive labels 710. Each label 710 is a separate and distinct item that is spaced apart from other labels on the web 22 by gaps 720 that extend along the length of the web 22. The pressure-sensitive adhesive labels can be formed on the web 22 using a wide variety of techniques. For example, the labels may be die-cut articles. In other embodiments, perforated labels may be formed with each label being defined by perforated lines. The labels are spaced apart at predetermined distances along the length of the web 22, and the labels 710 may have any suitable dimensions. The gap 720 can range from 2 mm to 14 mm, but the ideal market requirement is closer to 3-5 mm. The width of the web 22 may be of any appropriate size capable of being received within the print engine.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

It is believed that the foregoing description is sufficient for purposes of the present application to illustrate the general operation of an electrophotographic printing machine. Moreover, while the present invention is described in an embodiment of a single color printing system, there is no intent to limit it to such an embodiment. On the contrary, the present invention is intended for use in multi-color printing systems as well, or any other printing system having a cleaner blade and toner. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the followings claims.

What is claimed is:

1. An image forming device to print a continuous web of print media comprising:

a transfer system for printing on the print media, the transfer system having a rotatable image carrier capable of moving at a process speed and arranged to transfer one or more images to the continuous web of print media;

a transfer device (dicorotron) at the transfer system capable of applying a transfer field;

a transfer assist unit (TAB) at the transfer system capable of applying light pressure to back of the print media;

a fuser unit having a drive system and rolls in nipped relation, wherein the drive system causes rotation at the rolls so as to advance the print media; and a controller to control the transfer system and the fuser unit, wherein the controller is coupled to a memory for storing executable instructions to engage the continuous web of print media by directing the processor to:

operate the drive system at the process speed to create a first tension on the continuous web of print media as it advances through the nip;

operate the rotatable image carrier at the process speed;

operate the drive system at a speed lower than the process speed to create a second tension on the continuous web of print media as it advances through the nip, wherein the second tension creates a buckle zone prior to the fuser unit;

engage the transfer system to print on the print media.

2. The image forming device in accordance to claim 1, wherein engaging the transfer system comprises initially turning a transfer device to a low transfer field, engaging the transfer assist blade (TAB) to aid in the tacking of the continuous web of print media to the rotatable image carrier, fine tuning the transfer field until tacking occurs, and increasing the transfer field to a predetermined value for the print media.

3. The image forming device in accordance to claim 2, the image forming device memory further comprising executable instructions to disengage the continuous web of print media by directing the processor to:

operate the drive system at a speed higher than the process speed to create a third tension on the continuous web of print media as it advances through the nip;

disengage the transfer system from the print media;

operate the rotatable image carrier at a speed that is substantially at rest;

incrementally operate the drive system to reduce speed until the continuous web of print media is substantially at rest.

4. The image forming device in accordance to claim 2, wherein operate the drive system at the process speed to create a first tension further comprises achieving running stability and tracking stability of the continuous web of print media.

5. The image forming device in accordance to claim 4, wherein operate the rotatable image carrier to move the print media through the print station further comprises achieving tracking stability of the continuous web of print media.

6. The image forming device in accordance to claim 3, wherein disengage the transfer system from the print media further comprises waiting until the buckle zone is reduced and running stability of the continuous web of print media.

7. The image forming device in accordance to claim 3, wherein a speed lower than the process speed is nominal speed.

8. In a printing apparatus, a method of conveying a continuous web of print media from a marking station to a nip formed by a first roll and a second roll, comprising:

operating the first roll and second roll at a process speed to create a first tension on the continuous web of print media as it advances through the nip;

operating a rotatable image carrier to move through the marking station at the process speed;

operating the first roll and second roll at a speed lower than the process speed to create a second tension on the continuous web of print media as it advances through the nip, wherein the second tension creates a buckle zone prior to the a first roll and second roll;

engaging the marking station to print on the print media.

9. The method in accordance to claim 8, wherein engaging the transfer system comprises initially turning a transfer dicor to a low transfer field, engaging a transfer assist blade (TAB) to aid in the tacking of web to the rotatable image carrier, fine tuning the transfer field until full web to the rotatable image carrier tacking occurs, and increasing the transfer field to a predetermined value for the print media.

10. The method in accordance to claim 9, the method further comprising:

operating the first roll and second roll at a speed higher than the process speed to create a third tension on the continuous web of print media as it advances through the nip;

disengaging the marking station from the print media;

operating the rotatable image carrier at a speed that is substantially at rest;

incrementally operating the first roll and second roll to reduce speed until the continuous web of print media is substantially at rest.

11. The method in accordance to claim 9, wherein operating the first roll and second roll at the process speed to create a first tension further comprises achieving running stability and tracking stability of the continuous web of print media.

12. The method in accordance to claim 11, wherein operating the rotatable image carrier to move the print media through the marking station further comprises achieving tracking stability of the continuous web of print media.

13. The method in accordance to claim 10, wherein disengaging the marking station from the print media further comprises waiting until the buckle zone is reduced and running stability of the continuous web of print media.

14. The method in accordance to claim 10, wherein a speed lower than the process speed is nominal speed.

15. A printing assembly for printing a continuous web of print media comprising:

a sheet fed printer comprising a print station for printing an image on the print media, photoreceptor belt capable of moving at a process speed and arranged to transfer one or more images to the print media, and a print controller configured and arrange for controlling operation of the photoreceptor belt and the printing station, a continuous web print media feed unit including a continuous web of print media capable of receiving a print image, a print media fusing station configured and arranged for advancing the print media through the printer, at least one sensor for sensing the position of the print media as the print media is fed to the printer, and a fusing controller configured and arranged for controlling the operation of the print media fusing station, the fusing controller being in operative two-way communication with the print controller for sending at least one control signal to the print controller and for receiving at least one control signal from the print controller, the fusing controller is coupled to a memory for storing executable instructions to convey a continuous web of print media from the print station to a nip formed by a first roll and a second roll at the fusing station by:

operating the first roll and second roll at a process speed to create a first tension on the continuous web of print media as it advances through the nip;

operating photoreceptor belt to move through the print station at the process speed;

operating the first roll and second roll at a speed lower than the process speed to create a second tension on the continuous web of print media as it advances through the nip, wherein the second tension creates a buckle zone prior to the a first roll and second roll;

engaging the print station to print on the print media.

16. The printing assembly in accordance to claim 15, wherein engaging the print station comprises initially turning a transfer dicor to a low transfer field, engaging a transfer assist blade (TAB) to aid in the tacking of web to the photoreceptor belt, fine tuning the transfer field until full web to the photoreceptor belt tacking occurs, and increasing the transfer field to a predetermined value for the print media.

17. The printing assembly in accordance to claim 16, the fusing controller memory further comprising executable instructions to direct the processor to disengage the continuous web of print media by:

operating the first roll and second roll at a speed higher than the process speed to create a third tension on the continuous web of print media as it advances through the nip;

disengaging the marking station from the print media;

operating the photoreceptor belt at a speed that is substantially at rest;

incrementally operating the first roll and second roll to reduce speed until the continuous web of print media is substantially at rest;

wherein a speed lower than the process speed is nominal speed.

18. The printing assembly in accordance to claim 16, wherein operating the first roll and second roll at the process speed to create a first tension further comprises achieving running stability and tracking stability of the continuous web of print media.

19. The printing assembly in accordance to claim 18, wherein operating the photoreceptor belt to move the print media through the print station further comprises achieving tracking stability of the continuous web of print media.

20. The printing assembly in accordance to claim 17, wherein disengaging the print station from the print media further comprises waiting until the buckle zone is reduced and running stability of the continuous web of print media.

* * * * *